US005839539A

United States Patent [19]

Smith

[11] Patent Number: 5,839,539

[45] **Date of Patent: *Nov. 24, 1998**

[54] SCAFFOLD HANGAR CONSTRUCTION

[76] Inventor: John Smith, Box 45, Dover, Ohio 44622

[ * ] Notice: The terminal 49 months of this patent has been disclaimed.

[21] Appl. No.: 937,226

[22] Filed: Aug. 28, 1992

[51] Int. Cl.[6] ..... E01B 25/24

[52] U.S. Cl. ..... 182/150; 182/36; 248/222; 248/231.4; 104/111

[58] Field of Search ..... 182/150, 36; 248/228, 248/231.4; 104/111

[56] References Cited

U.S. PATENT DOCUMENTS 3,072,072 1/1963 McDonough ..... 104/111 X 3,929,078 12/1975 Sears ..... 248/228 X

FOREIGN PATENT DOCUMENTS 3113786 10/1982 Germany ..... 104/111

*Primary Examiner*—Alvin C. Chin-Shue
*Attorney, Agent, or Firm*—Roger D. Emerson

[57] ABSTRACT

A movable scaffold supporting device, for engaging the lower portion of a concrete girder or an I-beam type girder, including an elongated tubular member, an adjustable flange engaging arm mounted to the tubular member, an L-shaped head member, a spring loaded locking device which positively locks the head member against an I-beam or concrete girder, and a supplementary locking device. Further, the device includes rollers located beneath the bridge.

6 Claims, 4 Drawing Sheets

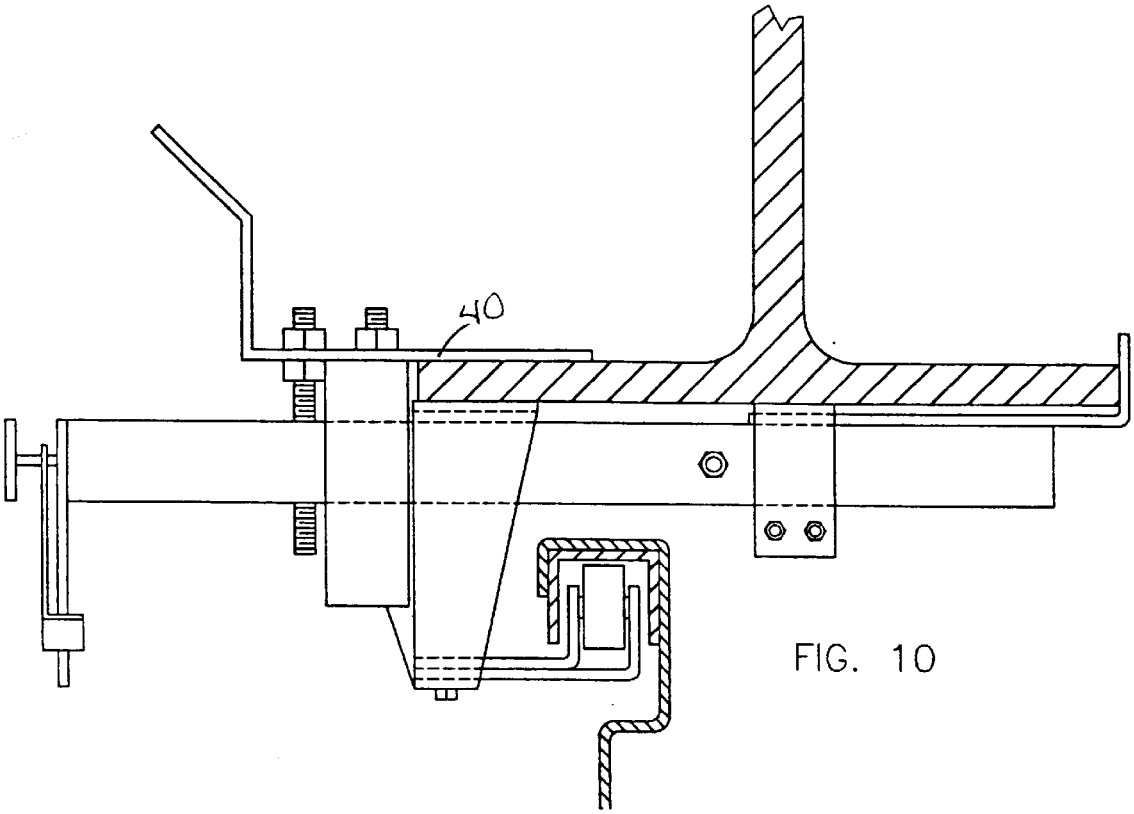
FIG. 10
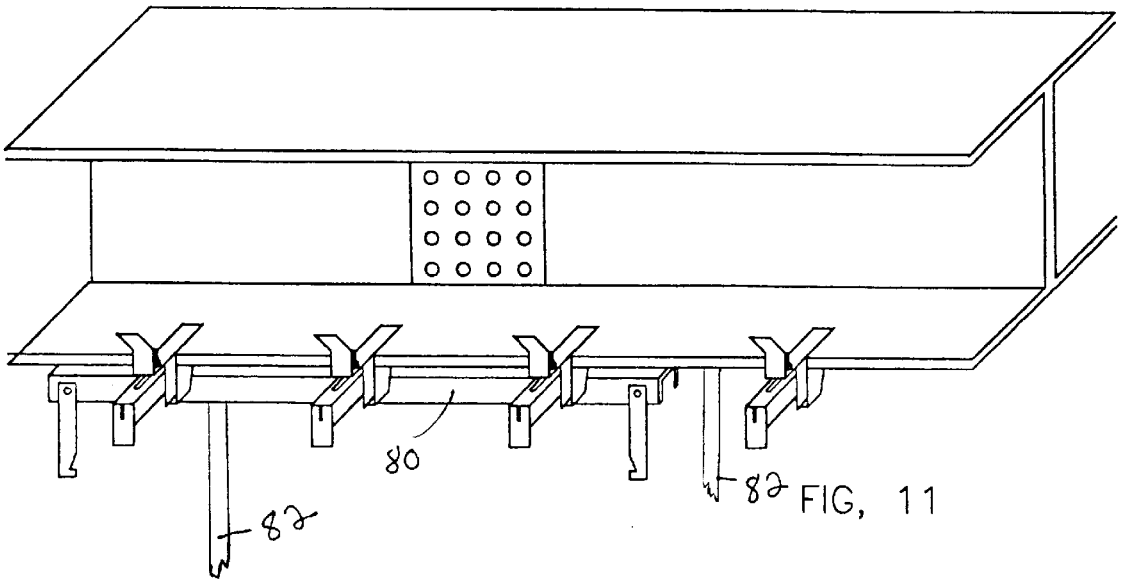
FIG, 11

SCAFFOLD HANGAR CONSTRUCTION

BACKGROUND OF THE INVENTION

1. Field of the Invention

The invention relates to a scaffold support construction and more particularly the invention relates to a construction for engaging a concrete girder or I-beam from which a scaffolding may be suspended to provide a platform for workmen.

2. Description of the Prior Art

Reinforced concrete bridges are commonly found on today's highways and are constructed from a series of elongated generally parallel arranged girders, such as I-beams. which are supported on vertical piers at selected spaced points between each end of the bridge. The bridge deck is supported on the tops of these I-beams and is formed of reinforced concrete. These girders are formed of a generally I-shape in cross section from an I-beam or an I-beam with reinforced concrete which encloses the steel I-beam. These constructions are commonly seen throughout the country. In many situations, the concrete girder consists of a steel I-beam enclosed or encased in reinforced concrete. The concrete girder may be used for any number of construction reasons including aesthetic or weather considerations.

During bridge construction and maintenance the installation and removal of concrete forms for erecting and maintaining portions of the bridge are required to accomplish the construction steps or maintenance steps necessary. Also, it is common to paint portions of the bridge, particularly any exposed steel, as a part of the bridge's construction, initially or as a maintenance procedure periodically thereafter.

It has been a common practice over the years to erect stationary scaffolding from the ground level up to the bridge level to provide a platform for construction workers to either build or remove concrete forms or to paint portions of the bridge. In many, if not most, situations it is impractical to build scaffolding from the ground up, and in order to provide a work platform for construction workers, cables have been strung from one end of the bridge to the other across the supporting piers. Wooden planks are then placed between two adjacent cables to provide a work platform. As is readily apparent, such procedure is extremely dangerous because cable supported platforms are very unstable.

To overcome the problems inherent in the stationary scaffolding built from the ground up or the cable supported scaffolding frequently used, particularly by bridge maintenance workers, scaffold support devices have been used which are suspended from I-beam girders, commonly used in reinforced concrete bridge constructions. However, where the girder is of the reinforced concrete type, no known structure has been used or proposed to support the scaffold system from such a concrete girder.

To overcome problems inherent in either the stationary scaffold or the cable supported scaffolding devices, various types of scaffold or scaffold supporting devices have been known in the prior art. For example, U.S. Pat. No. 2,761,396 discloses a structure in which a carriage may be suspended and moved along an I-beam. This device incorporates a plurality of rollers which roll upon the top surface of the I-beam and bottom flange. These rollers are capable of being swung out of the way when an obstacle along the length of the I-beam is present. Such a device, however, can only be used between bridge piers because there is no practical way for the device to be moved past the pier between the pier and the bottom of the bridge deck when the work between two piers is completed. Furthermore, such a device is, as a practical matter, incapable of being used to support scaffolding from a concrete reinforced I-beam type girder. Thus, the device, in the case of a normal and exposed I-beam, must be disassembled and moved around a pier and reassembled for continued use. In the case of the concrete I-beam, its use, for all practical purposes, is not possible.

Other examples in the prior art include devices which render them either inconvenient or undesirable from a practical standpoint when considering the fact that scaffolding must be moved past a pier to effectively and efficiently utilize the scaffolding. For example, prior art devices are limited in terms of moving along the length of the supporting girder to those points where braces extend between adjacent girders or at those positions where two girders are spliced together by means of steel plates bolted to the abutting ends of the beams. Where cross braces extend between two girders, there is no room for the device to pass beyond the cross brace. Similarly, where these devices actually roll along the top surface of the bottom flange of an I-beam, the location where bolts, rivets and other fasteners are located to splice two beams together, movement of the rolling members past the splice plate is prevented. These devices must, therefore, be disassembled to move them past those positions on a bridge deck which normally provide structures for the movement of the scaffolding.

I am unaware of any scaffold supporting system which may be used to support scaffold members which can be used upon either exposed I-beam girders or concrete reinforced girders, and wherein the scaffold supporting roller members are located below the lower flange of either the I-beam or the concrete reinforced girder, and in which the scaffolding can be moved along the entire length of the bridge beam.

SUMMARY OF THE INVENTION

It is, therefore, a primary object of the present invention to provide a movable scaffold supporting device for engaging the lower portion of a concrete girder or an I-beam type girder so that a suspended scaffold system may be supported beneath the bridge which includes concrete girders or I-beams as the deck supporting members.

It is a further object of the present invention to provide a bridge girder engaging hangar construction which is small and lightweight and adjustable to fit various sized girders and I-beams which can be handled easily by one workman, and which can be positively locked into place and positioned at a desired location on a concrete girder or I-beam.

It is another object of the present invention to provide a concrete girder or I-beam engaging hangar construction which may be used in a simple manner and which is simple, effective and inexpensive to construct, and which provides a means of suspending scaffolding beneath a concrete girder bridge which has heretofore been impractical in the past.

It is a still further object of the present invention to provide a concrete girder or I-beam engaging hangar construction for supporting scaffolding which may be used with either exposed steel I-beams located in many portions of the country and as well as being capable of being used with a concrete bridge girder which are located in certain other areas of the country. The two different types of supporting girders are used depending upon prevailing weather conditions found in the area in which the bridge is located, and the most desirable or practical type of supporting girder is employed to meet the needs of those weather conditions.

These and other objects and advantages may be obtained by the improved scaffold supporting systems of the present invention, the general nature of which may be stated as including an elongated tubular member which supports a roller member. At one end of the tubular member, a flange engaging arm is adjustably mounted to the tubular member to accommodate various widths of girders whether they be concrete enclosed I-beam types or exposed I-beam types. The device also includes an L-shaped head member which has an extension of one of the L-legs angled to approximately duplicate the profile of a concrete bridge girder. The head member is adjustably attached to the tubular member and is reversible in position 180° so that in one position the device may engage a concrete bridge girder, or when rotated 180° may engage the flange of an I-beam.

The device also includes a spring loaded locking device which positively locks the head member against an I-beam or concrete girder and a supplementary locking device to prevent the accidental disengagement of the head member locking device. An additional locking member is provided for the adjusting means that mounts the head member to the tubular member. Further, the device includes rollers which are located beneath the bridge girder so that scaffolding may be moved along a series of hangar devices, usually three or more, from place to place along a bridge girder.

In addition, the device includes means for adjustably mounting the device upon the lower flange of exposed I-beam bridge girders. In either configuration, that is when used to engage a concrete enclosed I-beam or an exposed I-beam, the device may be easily removed from its locked position by a single workman and moved to a new location by easy manipulation of various portions of the device including the spring loaded mechanism.

When a plurality of devices are mounted upon a bridge beam of either type, the roller member that is positioned underneath the beam lower surface is capable of supporting an inverted U-shaped channel member which in turn supports a plurality of yoke arms. A second set of beam engaging members is positioned to an adjacent bridge beam to support a second inverted U-shape rail that also includes yoke arms and supporting structure extending between the lower ends of the yoke arms. When assembled in this manner, platform members may be supported by the yoke supporting members to provide a work platform for workmen to perform tasks beneath this surface of the bridge deck and in and around the beams themselves. The inverted U-rail members further include latch devices to prevent the accidental or inadvertent movement of the rails until it is desired by the workmen to reposition the device.

In actual use, after work has been completed in those areas reachable from the platform work surface, one of the hangar members may be moved to a new position on the bridge beam and the opposite hangar member similarly placed on an adjacent bridge beam. The various locked devices are then manipulated by workmen and the platform assembly and yoke members and rail are moved along the rollers to a new location and the various locking member re-engaged to securely prevent inadvertent or accidental movement of the platform. This process is continued and can be accomplished along the entire length of the supporting beam without having to engage in complicated and difficult movements of various parts associated with prior art devices.

The various members, associated with the yoke means include the yoke arms, and the yoke bottom support members are adjustable so that the height of the platform can be predetermined and the distance between the yokes can be adjusted to fit the distance between adjacent supporting beam members.

BRIEF DESCRIPTION OF THE DRAWINGS

A brief description of the invention—illustrative of the best mode in which applicant has contemplated applying the principles—is set forth in the following description and is particularly and distinctly pointed out and set forth in the appended claims.

In the drawings:

FIG. 10 is a view similar to FIG. 2 illustrating the device as it engages an exposed I-beam type girder;

FIG. 11 is a diagrammatic view illustrating how the device is moved in "leap frog" fashion along a bridge beam to facilitate access to all areas under and adjacent to the scaffold.

Similar numerals refer to similar parts in the various figures of the drawings.

DESCRIPTION OF THE PREFERRED EMBODIMENT

Figure 1:
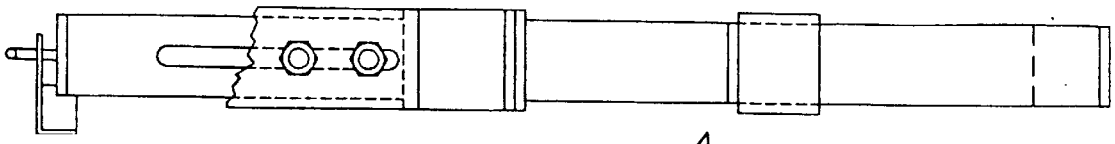
Fig. 1 is a top plan view, with portions broken away, of the beam engaging member of the present invention.

The hanger support of the present invention includes an elongated tubular member 20 having a carrier block 22 slidably mounted therein. Block 22 is spring biased by spring 24 which extends between block 22 and a spring retainer pin 26. One end of spring 24 is attached to pin 26 and the other end is attached to ear 28 of block 22. Block 22 is urged toward pin 26 by spring 24 when moved away from pin 26.

A pair of threaded rods 30 are threaded in and carried by block 22 and extend through elongated slots 32a and 32b formed in the upper face 34 and lower face 36 of elongated tube 20. The device also includes a beam engaging head member 40 which is mounted to rods 30 and adjustably secured by nuts 42. Head member 40 is L-shaped and includes a steel beam engaging end 46. Head member 40 is adjustably mounted on rods 30 either toward or away from tube 20 by movement of nuts 42. To prevent movement of head 40 a lock pin 48 is removably placed in holes formed through the upper end of rods 30. Nuts 42 are tightened to maintain head 40 at the desired position relative to tube 20 and in correct adjustment to engage a beam of a bridge.

The device also includes roller carriage member 50 formed in open ended box configuration with one end 50*a* attached to tube 20 by welding. Lower end 50*b* extends below tube 20 and carries a roller support arm 52 which is attached thereto by bolt assembly 54. Roller support arm 52 includes a horizontal support roller 56 and a guide roller 58 for guiding and supporting the scaffold system, as will be described below.

The device also includes an adjustable beam engaging arm 60 which is attached to the inner end 62 of tube 22 and movable along the top face of tube 20 so that when the device engages a bridge beam the device is maintained in position. This is done by bolt 64 which is mounted in holes 64*a* formed in dovetail portion 66 of arm 60. Arm 60 is maintianed in position on tube 20 by clamping bracket 68.

Figure 2:
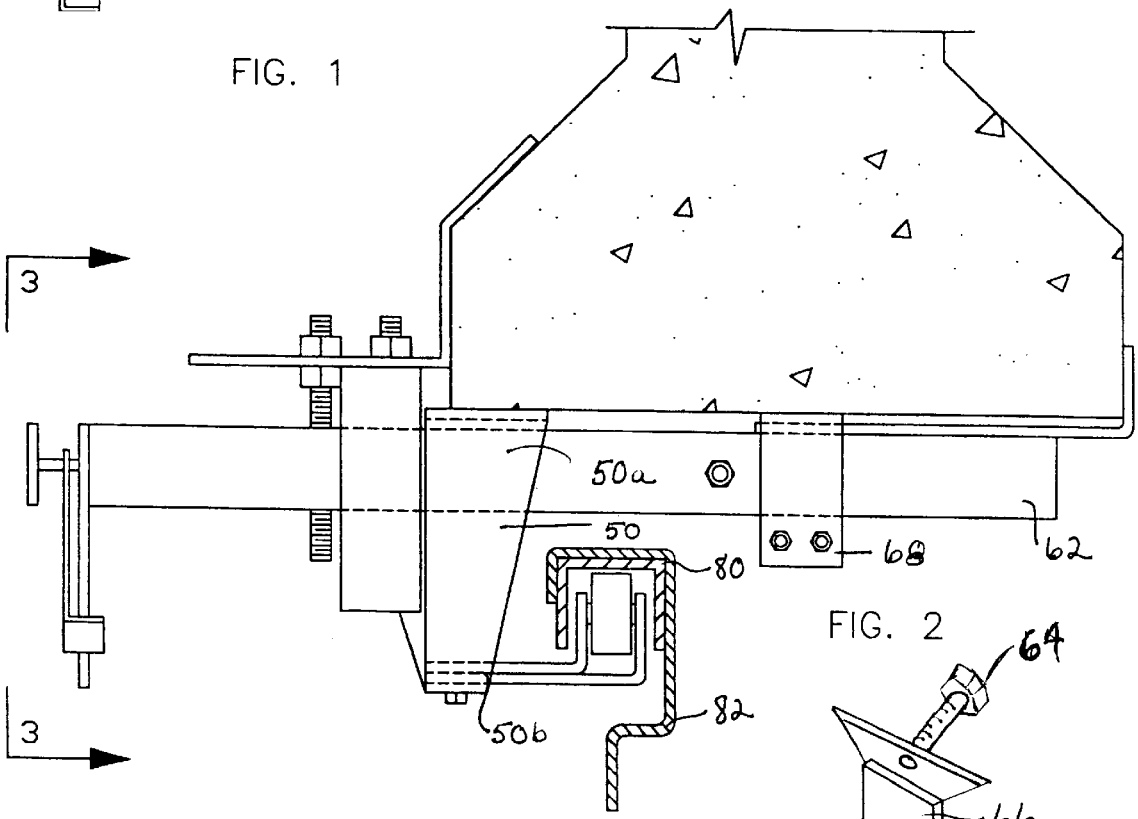
FIG. 2 is a side elevation of the engaging member of the present invention shown in the position as it engages a concrete enclosed I-beam.
Figure 4:
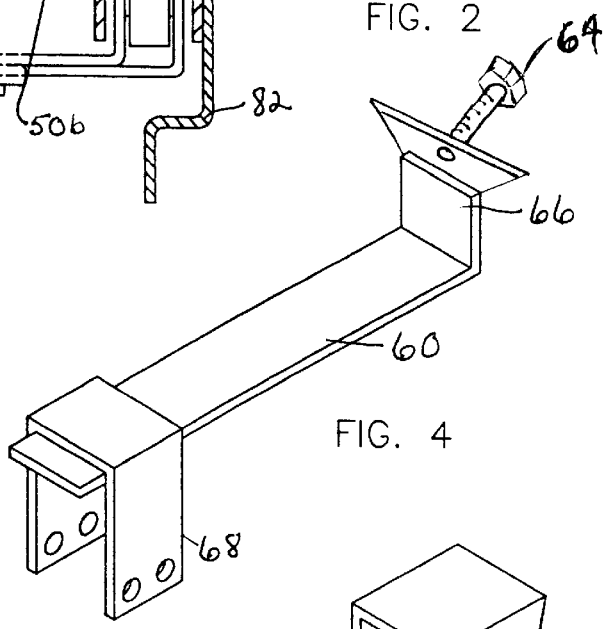
FIG. 4 is a perspective view of the adjusting flange engaging member which forms a portion of the present invention.
Figure 3:
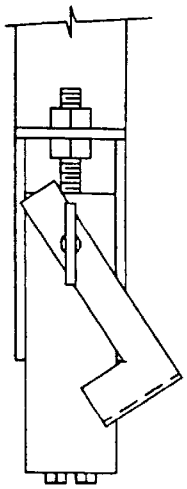
FIG. 3 is a side elevation showing portions of the locking means taken along the lines 3—3, FIG. 2.
Figure 5:
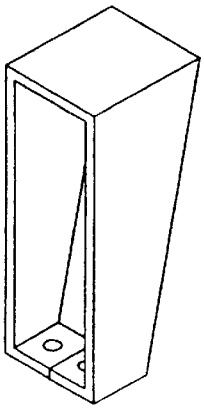
FIG. 5 is a perspective view of the member which supports the roller structure to the tubular hangar member.
Figure 8:
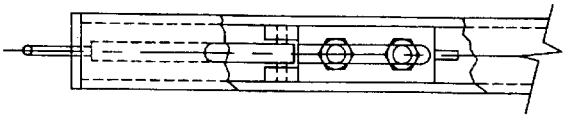
FIG. 8 is a cut-away portion of the hangar tubular member illustrating in plan view portions of the locking and adjusting member.
Figure 6:
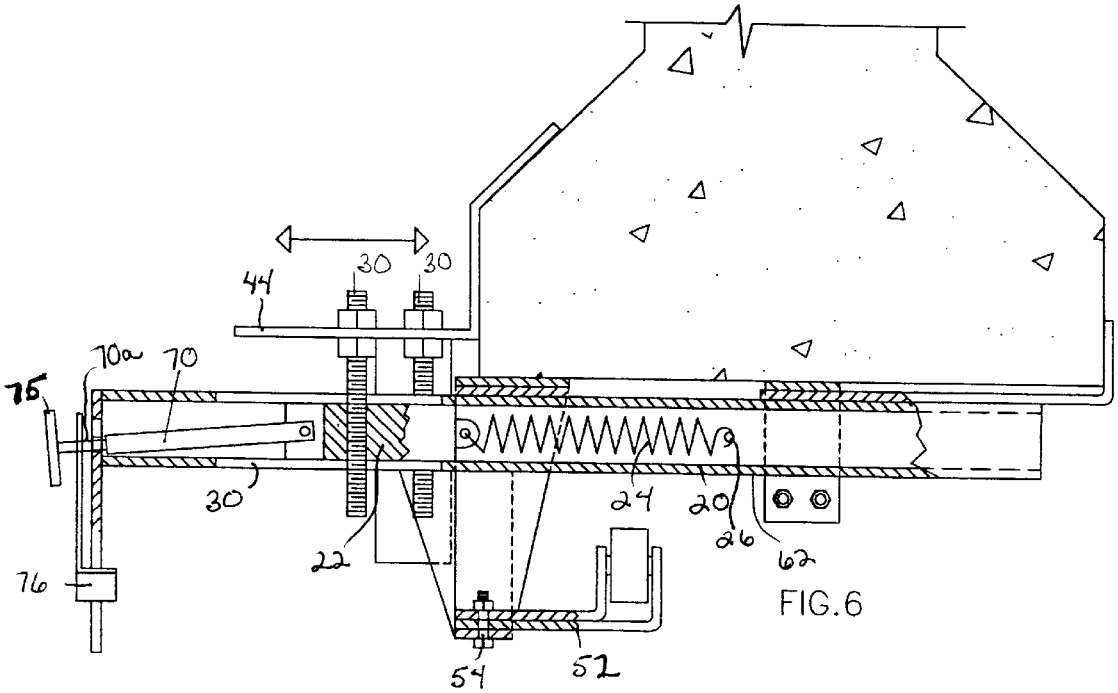
FIG. 6 is a view similar to FIG. 2 in section showing the spring loaded locking mechanism.

Block 22 is slidable within tube 20 and controls engagement of head 40 with a bridge beam. A locking system which is included in the system will now be described. The The locking system includes a locking pin 70 having one end attached to block 22 and the other end extending through a keyhole shaped aperture 72 formed in end plate 73 of tube 20. Pin 70 includes a shoulder 74 which is larger than one portion of keyhole 72 but smaller than the second portion. A smaller diameter portion 70*a* of pin 70 extends through keyhole 72 and has connected thereto a handle portion 75. In locked position, as shown in FIG. 2 and 6, head 40 engages one portion of a beam and arm 60, which has been adjusted into position, and engages the opposite portion of a bridge beam. Movement of block 22 and therefor head 40 is prevented by shoulder 74 engaging end plate 73 which prevents movement of block 22. A latch member 76 prevents pin 70 and shoulder 74 from being moved upwardly in slot 72 to disengage shoulder 74 from engagement with end plate 73.

Figure 9:
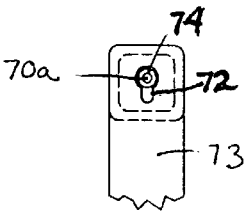
FIG. 9 is a view, taken on the lines 9—9 of FIG. 7 illustrating the supplementary locking mechanism which prevents disengagement of the device when in engaged position shown in FIGS. 2 and 6.
Figure 7:
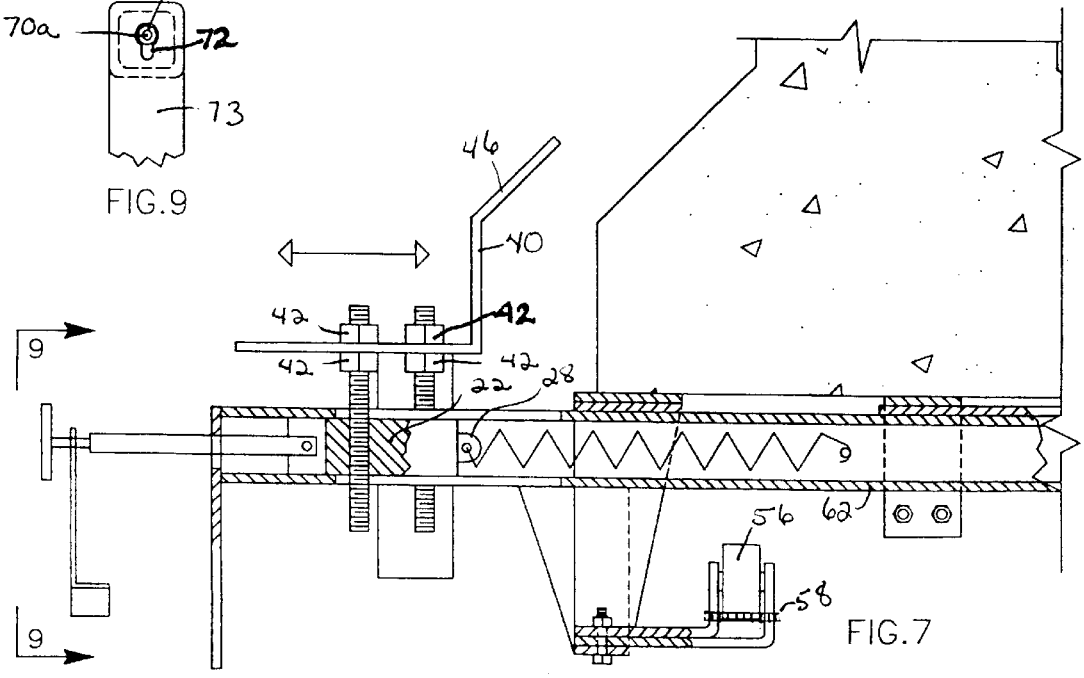
FIG. 7 is a view similar to FIG. 6 showing the device in unlocked position so that the hangar member may be removed from its locked supporting position shown in FIGS. 2 and 6.

To disengage head 40 from a beam, latch 76 is disengaged and pin portion 70*a* is moved upwardly to the position shown in FIG. 9 and allows shoulder 74 to pass through keyhole aperture 72. This allows sliding movement of block 22 in tube 20 away from pin 26 and therefor the bridge beam. Movement of block 22 can be accomplished by manual manipulation by pulling one of threaded rods 30 against spring bias exerted by spring 24.

The device is, therefore, engageable on a bridge beam by sliding block 22 manually inwardly and outwardly within tube 22 to allow head 40 and arm 60 to engage the opposite flanges of the beam. In the case of a concrete enclosed beam, the head member is oriented into the position shown in FIGS. 2 and 6 for engagement with the profile of a beam. If the bridge beam is of the unenclosed steel type, the head 40 is rotated 180° to the position shown in FIG. 20 so that head member 40 will engage the flange of the bridge, as shown in FIG. 10.

When the device is locked in the position shown in FIGS. 6 or 10, it is in position to support a scaffolding member, as shown in FIG. 2. The scaffolding member includes an inverted U-shaped channel member which is supported on rollers 56. The channel 80 will carry the yoke member 82 which hangs downwardly from inverted U-channel 80. In actual practice a plurality of hanger members are attached along one side of a bridge beam, as shown in FIGS. 11 through 14. A similar and oppositely oriented plurality of hanger members will be located at the next adjacent beam of the bridge which will support a similar U-shaped channel member 80 and a pair of yoke members 82. A scaffolding platform is carried by yokes 82 and extends between the two adjacent beam support constructions.

Figure 12:
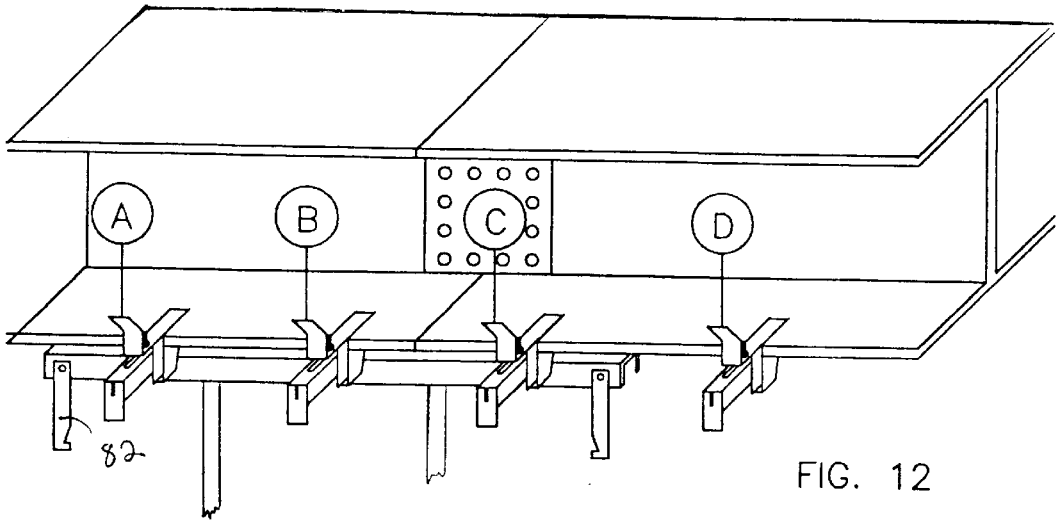
FIGS. 12—14 are diagrammatic view similar to FIG. 11 which illustrate further steps in the procedure of moving the hangers and scaffold system along a bridge beam.
Figure 13:
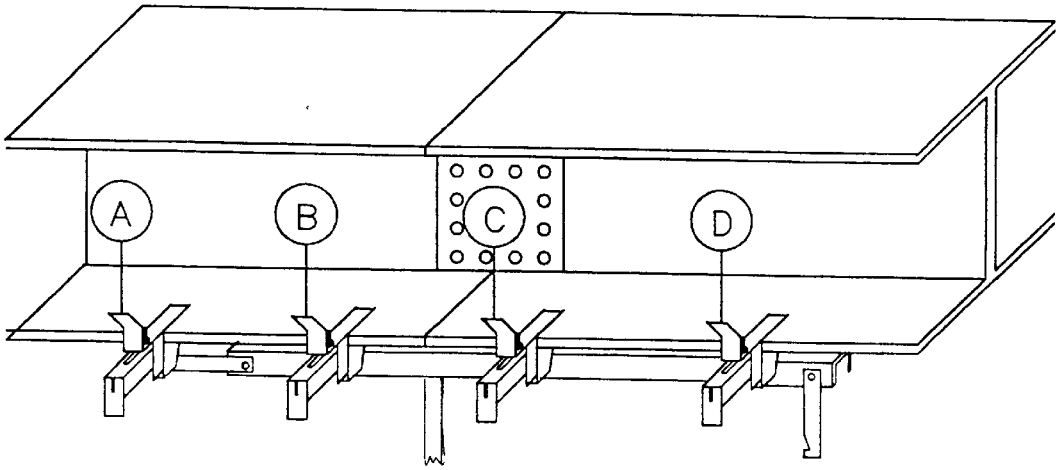
Figure 14:
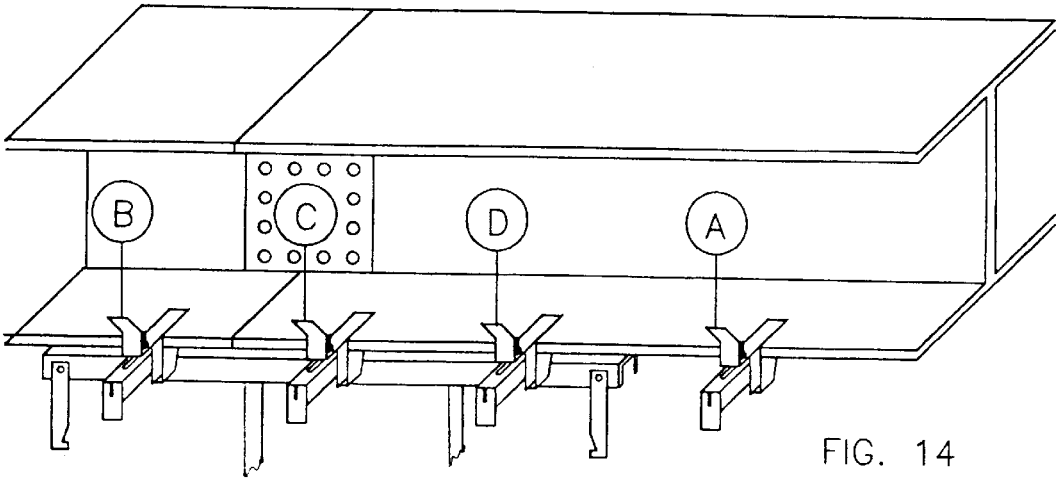

The manner of use of the system of the present invention is illustrated diagrammatically in FIGS. 11 through 14. In these views, one set of hangers on one side of the scaffolding is illustrated and it is to be understood that a similar but oppositely oriented set will be disposed along the next adjacent bridge beam with the scaffolding platform being supported by the yoke members of each and extending between the two sets of hangers and yoke members. When the workmen are finished working on a portion of the bridge, the hanger system will be as illustrated in FIG. 11. To proceed along the bridge beams to reposition the scaffolding so that the workmen may work on a different area, it will be necessary to move the scaffolding to reposition it so that the workmen have access to this new area. One of the plurality of hangers will be located at position D, as illustrated in FIG. 12. The inverted U-shaped track 80 is moved by rolling it along supporting rollers 56 in the direction of the arrow of FIG. 12. As can be appreciated from FIG. 12, the channel support 80 is initially supported by three hangers A, B and C, and as it is moved toward hanger D it will again be supported by three hangers, this time hangers B, C and D. Further movement of the hanger is prevented by stop member 82 which engages hanger A to stop further movement. Latch 82 must be manually disengaged by the workmen to allow continued movement. At this point hanger A is removed from the beam by disengaging the lock means on the hanger support and pulling the head member 40 away from the flange of the bridge and repositioning it, as in FIG. 14. Continued movement of the scaffolding along the bridge beam from one position to another is accomplished by repeated movement of the plurality of hangers which engage the two adjacent beams from one end of the beam to the other.

An important aspect of the invention, and as can be seen in FIG. 2, is that the entire scaffold system and most of the hangers are positioned below the bottom of the beam flange so that any obstruction on the top of the flange of the beam or extending between the beams will not interfere with movement of the system along the beams. Furthermore, another important aspect of the invention is the fact that the scaffold system is always supported by three hanger members on each side so long as the workmen correctly position the hangers as they are moving the hangers in leap-frog fashion.

This provides a high degree of safety for the workmen who will be working from the scaffold platform hanging below the bridge beam. A further advantage is provided by the fact that the simple movement of one hanger to a new position is all that is necessary to permit movement of the scaffold in a system as work progresses along the length of the beam. This is in contrast to those systems which roll on the top flange of the bridge beam, where obstructions such as splice plates or cross beam members would interfere with the movement of a hanger system that rolls on the top of the flange of the bridge beam.

In the foregoing description, certain terms have been used for brevity, clearness and understanding but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details of the construction shown or described.

Having now described the features, discoveries and principles of the invention, the manner in which the improved scaffold hanger construction is constructed, assembled and operated, the characteristics of the new construction, and the advantageous, new and useful results obtained; the new and useful structures, devices, elements, arrangements, parts and combinations are set forth in the appended claims.

I claim:

1. Scaffold hanger construction including an elongated tubular member, a roller member supported by the tubular member below the tubular member and between an inner and outer end of said tubular member and, a flange engaging arm adjustably mounted to the tubular member adjacent to the tubular member inner end, a head member adapted to engage a beam of a bridge flange, said head member being adjustably attached to the tubular member, a spring-biased block member slidably mounted within the tubular member and connected to the head member through adjustment means, lock means connected to the block, and said head member being adapted to engage alternately either a bridge I-beam or a concrete box beam and locked into engagement therewith for supporting a roller member beneath the bottom flange of the bridge beam.

2. Scaffold hanger construction as defined in claim 1 in which said lock means includes a keyhole shaped opening formed in the outer end of the tubular member and a pin having a shoulder extending through said aperture, said shoulder engaging the outer end of the tubular member in locked position and extending outside said tubular member in unlocked position.

3. Scaffold hanger construction as defined in claim 1 in which said head member includes an L-shaped arm having an angled terminal portion adapted to engage a concrete box bridge beam and alternately a flange of an I-beam.

4. Scaffold hanger construction as defined in claim 3 including means for locking the head means in selected position.

5. Scaffold hanger construction as defined in claim 2 including latch means for maintaining the locking means in locked position.

6. Scaffold hanger construction as defined in claim 1 in which said roller member is adapted to support an inverted U-shaped channel having a yoke means and a scaffold platform connected thereto.

* * * * *